United States Patent [19]

Salzberg

[11] 3,932,822

[45] Jan. 13, 1976

[54] BROAD BAND ORTHOGONAL MODE JUNCTION

[76] Inventor: Edward Salzberg, 19 Black Oak Road, Wayland, Mass. 01778

[22] Filed: Jan. 30, 1975

[21] Appl. No.: 545,711

[52] U.S. Cl. ..... 333/9; 333/11; 333/21 A

[51] Int. Cl.[2] ..... H01P 1/16; H01P 5/12

[58] Field of Search ..... 333/9, 11, 21 R, 21 A

[56] References Cited

UNITED STATES PATENTS

| | | | |
|---|---|---|---|
| 2,973,486 | 2/1961 | Salzberg | 333/11 X |
| 3,162,828 | 12/1964 | Schmidt et al. | 333/11 X |
| 3,327,250 | 6/1967 | Sleeper, Jr. | 333/9 X |

*Primary Examiner*—Paul L. Gensler

*Attorney, Agent, or Firm*—Thomas N. Tarrant

[57] ABSTRACT

An orthogonal mode waveguide junction having a dual mode common arm capable of receiving or transmitting energy simultaneously in two orthogonally related directions of polarization, an E-arm, and an H-arm meeting in a common junction region. Matching structure is included entirely within the junction region. The junction is usable over a great part of the band normally usable with a waveguide designed to the same center frequency.

7 Claims, 3 Drawing Figures

BROAD BAND ORTHOGONAL MODE JUNCTION

BACKGROUND OF THE INVENTION

1. Field of the Invention

The present invention relates to waveguide junctions and particularly to a three-port junction in which one of the ports will accept energy in two orthogonally related directions of polarization and the other two ports are E- and H-arm ports.

2. Description of the Prior Art

Past three-port junctions in which one port accepts two orthogonally related modes have been commonly designed for operation over a narrow frequency range. For example, the present junction was obtained in designing a junction for use between 5,200 and 5,800 MHz. Beyond a design frequency band with a frequency ratio of about 1.1 to 1, voltage standing waves commonly produced by junctions of this type become excessively high.

A voltage standing wave ratio over 1.5 is normally considered unacceptable and waveguide will normally propagate energy with acceptable efficiency over a frequency band having a ratio of about 1.5. Thus, in order to use the same waveguide junction over the whole useful frequency range of a particular waveguide, the junction desirably introduces less than a 1.5 VSWR over a frequency ratio of 1.5 to 1.

SUMMARY OF THE INVENTION

The present invention was the result of experimenting with variations of orthogonal mode junction configurations to find one economical to produce that operated well over a frequency ratio of 1.1 to 1. Upon arriving at a satisfactory design, it was found quite unexpectedly to operate broad band.

The inventive junction has a square cross section orthogonal mode common arm which meets E and H arms at a junction such that the orthogonal mode arm is as the upright of a Tee and the other arms form the top of the Tee.

One broad wall of the E-arm is substantially coextensive with one narrow wall of the H-arm. The coextensive narrow wall of the H-arm is interrupted by a lateral protrusion while the coextensive broad wall of the E-arm is interrupted beyond the narrow width of the H-arm by protrusions beginning in stepped fashion and leading into a 45° sloped juncture of the E and H arms slanting toward the other narrow wall of the H-arm. On the wall where the common arm meets the other broad wall of the E-arm, a protruding button is positioned. These various protrusions providing the matching structure are all within a roughly cubical junction space where the three arms meet.

Thus it is an object of the invention to provide a broad band orthogonal mode waveguide junction.

Further objects and features will become apparent upon reading the following description together with the drawing.

DESCRIPTION OF THE PREFERRED EMBODIMENT

Figure 1:
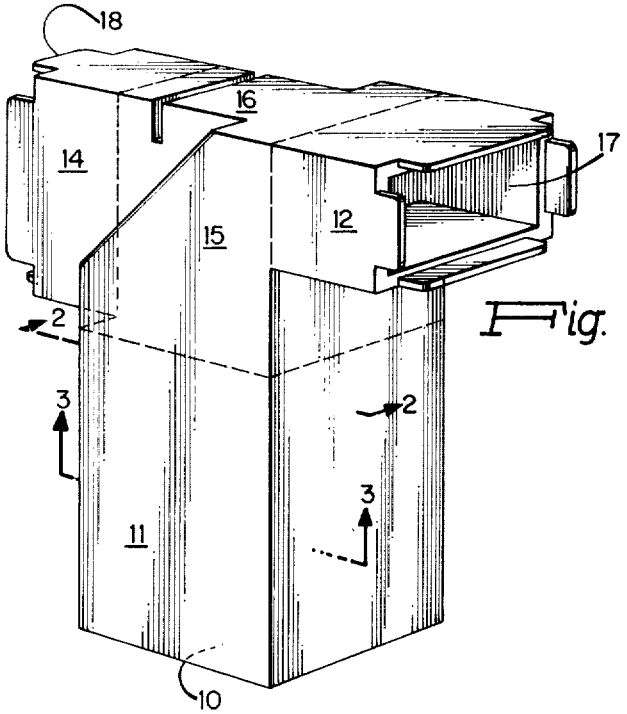
FIG. 1 is a perspective view of the inventive junction.
Figure 3:
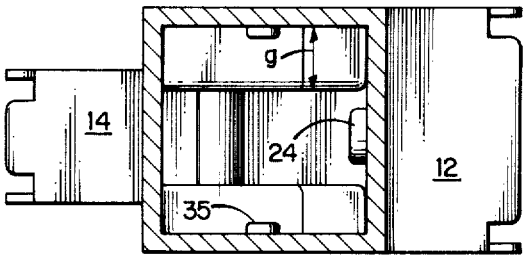
FIG. 3 is a section taken along 3—3 of FIG. 1.

The orthogonal mode tee of the invention is depicted standing on common arm port 10 in FIG. 1. The three arms are common arm 11, E-arm 12 and H-arm 14. For reference purposes, E-arm 12 is defined as the arm having a broad wall meeting a wall of the common arm directly at right angles while H-arm 12 is defined as the arm having a narrow wall meeting a wall of the common arm directly at right angles. A roughly cubical region indicated by dashed lines in FIG. 1 is defined as junction region 15. Region 15 starts as a cross section of arm 11 where it meets arm 14 and extends to coextensive wall 16 of both arms 12 and 14. Arm 12 terminates in port 17 facing the opposite direction from port 18 which terminates arm 14. Ports 10, 17 and 18 may be fitted directly to waveguide or other mating components or may terminate in flanges (not shown) for choke or similar coupling to mating components.

Figure 2:
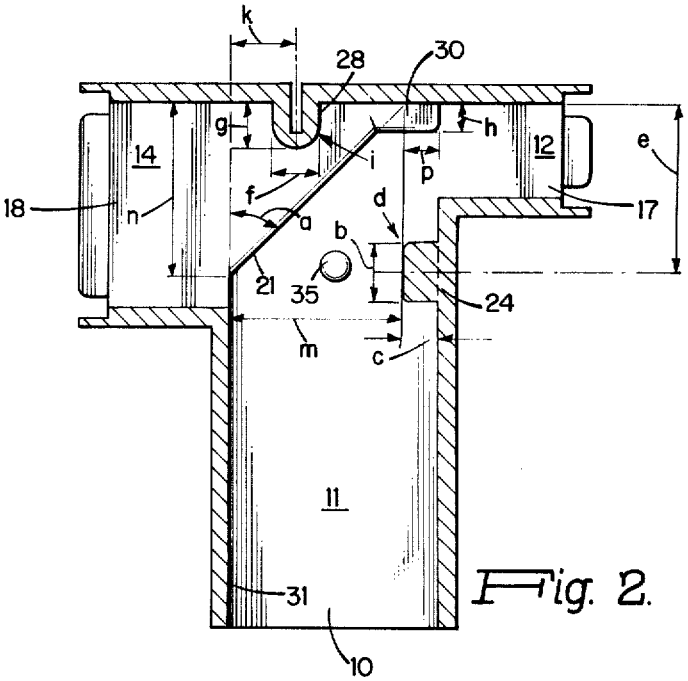
FIG. 2 is a section taken along 2—2 of FIG. 1.

The internal structure in junction region 15 is the most critical to the invention and is depicted in the sectional drawing FIG. 2. Since it is difficult in a structure such as this to determine exactly the nature of the contribution provided by each part of the matching structure, the present description provides the necessary disclosure in actual dimensions for an "X-band" junction rather than theoretically critical relationships of various structural parts. Junctions for other frequencies can be scaled to provide comparable results. The Drawing is scaled 1 to 1 and Table I gives the internal dimensions of the junction region.

Protrusion 28 is in essence an inductive iris providing matching for the H-arm while the configuration of juncture 21 together with step 30 and capacitive button 24 provides E-arm matching.

Additional buttons 35 on the front and back interior walls of the junction region can be added to provide additional tailoring on an empirical basis for particular junctions. Buttons 35 are capacitive buttons effecting the H-arm primarily.

Table II gives the response obtained with the orthogonal mode junction dimensioned in Table I. The Table II data was obtained with common arm 11 terminated with its characteristic impedance and the generator connected to the arm being measured. No terminations were provided to the third arm in either case since it was beyond cutoff for the polarization of the applied frequency.

TABLE I

| Internal Dimensions | |
|---|---|
| Arm 10— 1.372 in. × 1.372 in. | |
| Arm 17 — 1.372 in. × .622 in. | |
| Arm 18 — .622 in. × 1.372 in. | |
| Angle a | 45° |
| Button Diameter b | .375 in. |
| Button Height c | .192 in. |
| Button Curvature radius d | .093 in. |
| Button center distance e from coextensive wall | 1.147 in. |
| Protrusion width f | .332 in. |
| Protrusion depth g | .332 in. |
| Step depth h | .190 in. |
| Step length p | .190 in. |
| Distance k of protrusion center from extended line of common wall 31 | .418 in. |
| Protrusion curvature radius i | .156 in. |
| Distance m from the extended line of wall 31 to the intersection of wall 16 and the extended line of juncture 21 | 1.150 in. |
| Distance n from wall 16 to | 1.150 in. |

TABLE I-continued

| Internal Dimensions |
|---|
| intersection of juncture 21 and wall 31 |

TABLE II

| Frequency Characteristics | | |
|---|---|---|
| Freq., MHz | E-Arm VSWR | H-Arm VSWR |
| 4500 | 1.18 | 1.27 |
| 4600 | 1.21 | 1.30 |
| 4800 | 1.11 | 1.25 |
| 5000 | 1.10 | 1.18 |
| 5200 | 1.07 | 1.16 |
| 5400 | 1.05 | 1.07 |
| 5600 | 1.03 | 1.03 |
| 5800 | 1.02 | 1.02 |
| 6000 | 1.11 | 1.04 |
| 6200 | loses | 1.10 |
| 6400 | mode | 1.15 |
| 6600 | discrimination | 1.25 |
| 6800 | | 1.35 |
| 7000 | | 1.5 |

The present orthogonal mode junction is readily cast in one integral piece. However, it is the present practice to add capacitive button 24, as well as buttons 35 when used, after casting. It is to be noted that button 24 is spaced more than one-half inch on center from the interior intersection of the common arm wall with the broad E-arm wall. This spacing is substantially different from past practice and it is believed to have particular benefit in obtaining the broad band results described.

In considering the performance as indicated in Table II, it will be noted that the E-arm is useful only over a frequency ratio of 1.33 while the H-arm is useful over a frequency ratio of 1.5. The wider frequency range of the H-arm is not rendered valueless beyond the useful range of the E-arm. In some applications the E-arm will actually require little band width. Where the E-arm performance is important, the useful range of the E-arm is still unusually large in this type of junction.

While the invention has been described in relation to a particular embodiment, it can readily be scaled to meet other frequency band requirements and may be terminated with ports for specific uses that are much different from the simple connecting ports depicted herein. Thus it is intended to cover the invention as set forth in the full scope of the appended claims.

I claim:

1. A three-arm microwave junction comprising:

a. a first arm of waveguide that will propagate a fundamental mode in two orthogonally related directions of polarization;

b. a second arm of waveguide that will propagate a fundamental mode in only one of said two directions of polarization, c. a third arm of waveguide that will propagate a fundamental mode only in the second of said two directions of polarization;

d. a junction region joining said first, second and third waveguide arms together so that energy in a first of said two orthogonally related directions of polarization will couple between said second arm and said first arm only and energy in the second of said two orthogonally related directions of polarization will couple between said third arm and said first arm only; and, e. matching structure in said junction region comprising a protruding ridge across a narrow wall proximate said third arm, a step structure protruding from a broad wall coextensive with said narrow wall and proximate said second arm, said step structure extending into slanting junctures joining said second and third arms along a diagonal within said junction region, and a protruding button in the center of a wall coextensive with a wall of said first arm said button being in spaced proximity to said second arm.

2. A three-arm microwave junction according to claim 1 wherein said first arm has a square cross section and each of said second and third arms have an oblong cross section with one dimension the same as a cross section dimension of said first arm and the other dimension smaller, the second and third arms connected to said junction region facing in opposite directions with their larger cross-sectional dimensions rotated at right angles to each other.

3. A three-arm microwave junction according to claim 2 wherein a broad wall of said second arm is coextensive with a narrow wall of said third arm across said junction region and it is this wall in the junction region from which said step structure and said ridge protrude.

4. A three-arm microwave junction according to claim 3 wherein said slanting junctures lie along a 45° diagonal.

5. A three-arm microwave junction according to claim 2 wherein said second arm is an E-plane arm, said third arm is an H-plane arm and said junction region is the region of said junction within the extended walls of said first arm commencing at the intersection with said H-plane arm and ending at said broad wall coextensive with said narrow wall, said junction region containing all matching structure of said microwave junction.

6. A three-arm microwave junction according to claim 5 wherein said button is a capacitive dome located in spaced proximity to a broad wall of said second arm.

7. A three-arm microwave junction according to claim 6 wherein said step structure is for matching said second arm at said junction region and said ridge is an inductive iris for matching said third arm at said junction region.

* * * * *